US010871736B2

(12) United States Patent
Inoue et al.

(10) Patent No.: US 10,871,736 B2
(45) Date of Patent: Dec. 22, 2020

(54) FIXING DEVICE AND IMAGE FORMING APPARATUS

(71) Applicants: Daisuke Inoue, Tokyo (JP); Tomoya Adachi, Kanagawa (JP); Yuusuke Furuichi, Kanagawa (JP)

(72) Inventors: Daisuke Inoue, Tokyo (JP); Tomoya Adachi, Kanagawa (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/715,348

(22) Filed: Dec. 16, 2019

(65) Prior Publication Data

US 2020/0249602 A1 Aug. 6, 2020

(30) Foreign Application Priority Data

Jan. 31, 2019 (JP) ..... 2019-015646

(51) Int. Cl.

| | |
|---|---|
| ***G03G 15/20*** | (2006.01) |
| ***G03G 15/01*** | (2006.01) |
| ***G03G 15/00*** | (2006.01) |

(52) U.S. Cl.

CPC ..... *G03G 15/2053* (2013.01); *G03G 15/0189* (2013.01); *G03G 15/2017* (2013.01); *G03G 15/657* (2013.01)

(58) Field of Classification Search

CPC ..... G03G 15/0189; G03G 15/2017; G03G 15/2028; G03G 15/2053; G03G 15/657

See application file for complete search history.

(56) References Cited

U.S. PATENT DOCUMENTS

| | | | | |
|---|---|---|---|---|
| 2013/0266332 | A1 | 10/2013 | Miyazaki et al. | |
| 2013/0279953 | A1* | 10/2013 | Chikugo | G03G 15/657 399/322 |
| 2014/0099146 | A1 | 4/2014 | Fujii et al. | |
| 2014/0153983 | A1 | 6/2014 | Fujii et al. | |
| 2015/0086250 | A1* | 3/2015 | Hara | G03G 15/2053 399/322 |
| 2015/0139705 | A1 | 5/2015 | Furuichi et al. | |
| 2018/0101118 | A1* | 4/2018 | Hiroe | G03G 15/657 |
| 2018/0136592 | A1* | 5/2018 | Takahashi | G03G 15/657 |
| 2019/0286026 | A1 | 9/2019 | Furuichi et al. | |

FOREIGN PATENT DOCUMENTS

| | | |
|---|---|---|
| JP | 2015-084084 | 4/2015 |

* cited by examiner

*Primary Examiner* — Sophia S Chen

(74) *Attorney, Agent, or Firm* — Harness, Dickey & Pierce P.L.C.

(57) ABSTRACT

A fixing device includes an endless belt that rotates and a pressure rotator that rotates and presses against the endless belt to form a fixing nip between the endless belt and the pressure rotator, through which a recording medium bearing an image is conveyed. A heater is disposed inside a loop formed by the endless belt. The heater heats the endless belt. A conductor is disposed upstream from the pressure rotator in a recording medium conveyance direction and grounded. The conductor contacts and detects the recording medium.

20 Claims, 11 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-015646, filed on Jan. 31, 2019, in the Japan Patent Office, the entire disclosure of which is hereby incorporated by reference herein.

BACKGROUND

Technical Field

Exemplary aspects of the present disclosure relate to a fixing device and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a fixing belt and a pressure rotator, such as a pressure roller, disposed opposite the fixing belt. The pressure rotator contacts the fixing belt to form a fixing nip therebetween. As a sheet serving as a recording medium that bears an unfixed toner image is conveyed through the fixing nip, the fixing belt and the pressure rotator fix the unfixed toner image on the sheet under heat and pressure.

The fixing device further includes a heater, such as a halogen heater, that heats the fixing belt. The heater is disposed inside a loop formed by the fixing belt. As the heater is applied with an alternating current (AC), the heater generates heat, thus heating the fixing belt.

However, in the image forming apparatus incorporating the fixing device, the alternating current may disadvantageously flow to a transfer nip where the toner image is transferred onto the sheet. For example, the transfer nip is a secondary transfer nip formed between an intermediate transfer belt and a secondary transfer roller and disposed upstream from the fixing device in a sheet conveyance direction. While the sheet is nipped at the fixing nip and the transfer nip, the alternating current applied to the heater may flow onto the sheet from the heater through the fixing belt. The alternating current may flow to the transfer nip through the sheet. When an alternating current waveform affects a transfer bias, the toner image transferred onto the sheet may suffer from uneven density.

SUMMARY

This specification describes below an improved fixing device. In one embodiment, the fixing device includes an endless belt that rotates and a pressure rotator that rotates and presses against the endless belt to form a fixing nip between the endless belt and the pressure rotator, through which a recording medium bearing an image is conveyed. A heater is disposed inside a loop formed by the endless belt. The heater heats the endless belt. A conductor is disposed upstream from the pressure rotator in a recording medium conveyance direction and grounded. The conductor contacts and detects the recording medium.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
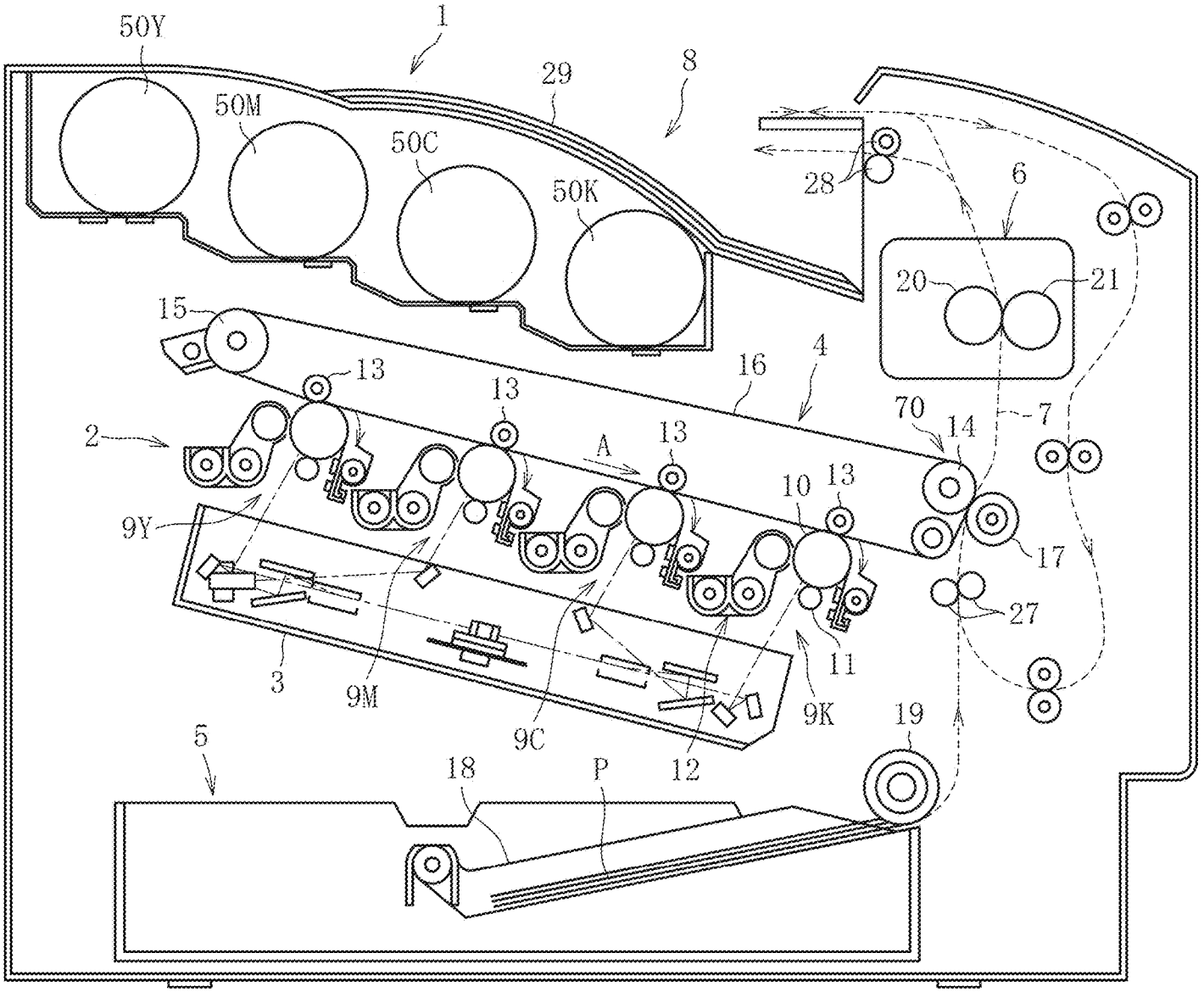
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure.

In the drawings, identical reference numerals are assigned to identical elements and equivalents and redundant descriptions of the identical elements and the equivalents are summarized or omitted properly.

Referring to FIG. 1, a description is provided of a construction of an image forming apparatus 1 that forms a color toner image on a recording medium.

An image forming device 2 is disposed in a center portion of the image forming apparatus 1. The image forming device 2 includes four process units 9Y, 9M, 9C, and 9K that are removably installed in the image forming device 2. The process units 9Y, 9M, 9C, and 9K have a similar construction except that the process units 9Y, 9M, 9C, and 9K contain developers in different colors, that is, yellow (Y), magenta (M), cyan (C), and black (K), respectively, which correspond to color separation components for a color image.

For example, each of the process units 9Y, 9M, 9C, and 9K includes a photoconductive drum 10, a charging roller 11, and a developing device 12. The photoconductive drum 10 is a drum-shaped rotator serving as an image bearer that bears a toner image formed with toner as a developer on a surface thereof. The charging roller 11 uniformly charges the surface of the photoconductive drum 10. The developing device 12 includes a developing roller that supplies toner onto the surface of the photoconductive drum 10, forming a toner image thereon.

An exposure device 3 is disposed below the process units 9Y, 9M, 9C, and 9K. The exposure device 3 emits a laser beam according to image data.

A transfer device 4 is disposed above the image forming device 2. The transfer device 4 includes a driving roller 14, a driven roller 15, an intermediate transfer belt 16, and primary transfer rollers 13. The intermediate transfer belt 16 is an endless belt stretched taut across the driving roller 14 and the driven roller 15 such that the intermediate transfer belt 16 is rotatable in a rotation direction A. The primary transfer rollers 13 are disposed opposite the photoconductive drums 10 of the process units 9Y, 9M, 9C, and 9K, respectively, via the intermediate transfer belt 16. The primary transfer rollers 13 press against an inner circumferential surface of the intermediate transfer belt 16, bringing an outer circumferential surface of the intermediate transfer belt 16 into contact with the photoconductive drums 10 and forming primary transfer nips between the intermediate transfer belt 16 and the photoconductive drums 10, respectively.

A secondary transfer roller 17 is disposed opposite the driving roller 14 via the intermediate transfer belt 16. The secondary transfer roller 17 presses against the outer circumferential surface of the intermediate transfer belt 16. Thus, a secondary transfer nip is formed between the secondary transfer roller 17 and the intermediate transfer belt 16 contacted by the secondary transfer roller 17. The driving roller 14, the intermediate transfer belt 16, and the secondary transfer roller 17 construct an image transferor 70 that transfers a toner image onto a sheet P.

A sheet feeder 5 is disposed in a lower portion of the image forming apparatus 1. The sheet feeder 5 includes a sheet feeding tray 18 (e.g., a paper tray) and a sheet feeding roller 19. The sheet feeding tray 18 loads a plurality of sheets P serving as recording media. The sheet feeding roller 19 picks up and feeds a sheet P from the sheet feeding tray 18. A conveyance path 7 conveys the sheet P picked up from the sheet feeder 5. A plurality of conveying roller pairs, in addition to a registration roller pair 27, is disposed properly in the conveyance path 7 that leads to a sheet ejector 8 described below.

A fixing device 6 includes a fixing belt 20 heated by a heater and a pressure roller 21 that presses against the fixing belt 20.

The sheet ejector 8 is disposed downstream from the conveyance path 7 at a most downstream portion of the image forming apparatus 1 in a sheet conveyance direction. The sheet ejector 8 includes a sheet ejection roller pair 28 and a sheet ejection tray 29. The sheet ejection roller pair 28 ejects the sheet P onto an outside of the image forming apparatus 1. The sheet ejection tray 29 stocks the sheet P ejected onto the outside of the image forming apparatus 1.

Toner bottles 50Y, 50M, 50C, and 50K are disposed in an upper portion of the image forming apparatus 1 and replenished with yellow, magenta, cyan, and black toners, respectively. The toner bottles 50Y, 50M, 50C, and 50K are removably installed in the image forming apparatus 1. The toner bottles 50Y, 50M, 50C, and 50K supply fresh yellow, magenta, cyan, and black toners to the developing devices 12 through supplying tubes disposed between the toner bottles 50Y, 50M, 50C, and 50K and the developing devices 12, respectively.

Referring to FIG. 1, a description is provided of a basic image forming operation performed by the image forming apparatus 1 having the construction described above. As the image forming apparatus 1 starts the image forming operation, an electrostatic latent image is formed on the surface of the photoconductive drum 10 of each of the process units 9Y, 9M, 9C, and 9K. The exposure device 3 exposes the photoconductive drums 10 according to image data. The image data is monochrome image data created by decomposing desired full color image data into yellow, magenta, cyan, and black image data. The drum-shaped developing roller supplies the toner stored in the developing device 12 to the electrostatic latent image formed on the photoconductive drum 10, visualizing the electrostatic latent image as a visible toner image (e.g., an image developed with a developer).

In the transfer device 4, as the driving roller 14 is driven and rotated, the driving roller 14 drives and rotates the intermediate transfer belt 16 in the rotation direction A. Each of the primary transfer rollers 13 is applied with a voltage at a polarity opposite a polarity of charged toner under one of a constant voltage control and a constant current control. Thus, a transfer electric field is created at each of the primary transfer nips. The toner images formed on the photoconductive drums 10, respectively, are transferred onto the intermediate transfer belt 16 successively at the primary transfer nips such that the toner images are superimposed on the intermediate transfer belt 16, thus forming a full color toner image on the intermediate transfer belt 16.

On the other hand, as the image forming operation starts, in the lower portion of the image forming apparatus 1, the sheet feeding roller 19 of the sheet feeder 5 starts being driven and rotated, feeding a sheet P of the plurality of sheets P loaded in the sheet feeding tray 18 to the conveyance path 7. The registration roller pair 27 conveys the sheet P sent to the conveyance path 7 to the secondary transfer nip formed between the secondary transfer roller 17 and the intermediate transfer belt 16 pressed by the driving roller 14 at a time when the full color toner image formed on the intermediate transfer belt 16 reaches the secondary transfer nip. The secondary transfer roller 17 is applied with a transfer voltage having a polarity opposite a polarity of charged toner of the full color toner image formed on the intermediate transfer belt 16, thus creating a transfer electric field at the secondary transfer nip. The transfer electric field formed at the secondary transfer nip transfers the full color toner image formed on the intermediate transfer belt 16 onto the sheet P collectively.

The sheet P transferred with the full color toner image is conveyed to the fixing device 6 where the fixing belt 20 and the pressure roller 21 fix the full color toner image on the sheet P under heat and pressure. The sheet P bearing the fixed toner image is separated from the fixing belt 20. The conveying roller pair conveys the sheet P to the sheet ejector 8 where the sheet ejection roller pair 28 ejects the sheet P onto the sheet ejection tray 29.

The above describes the image forming operation to form the full color toner image on the sheet P. Alternatively, one of the four process units 9Y, 9M, 9C, and 9K may be used to form a monochrome toner image or two or three of the four process units 9Y, 9M, 9C, and 9K may be used to form a bicolor toner image or a tricolor toner image.

A description is provided of a construction of the fixing device 6.

Figure 2:
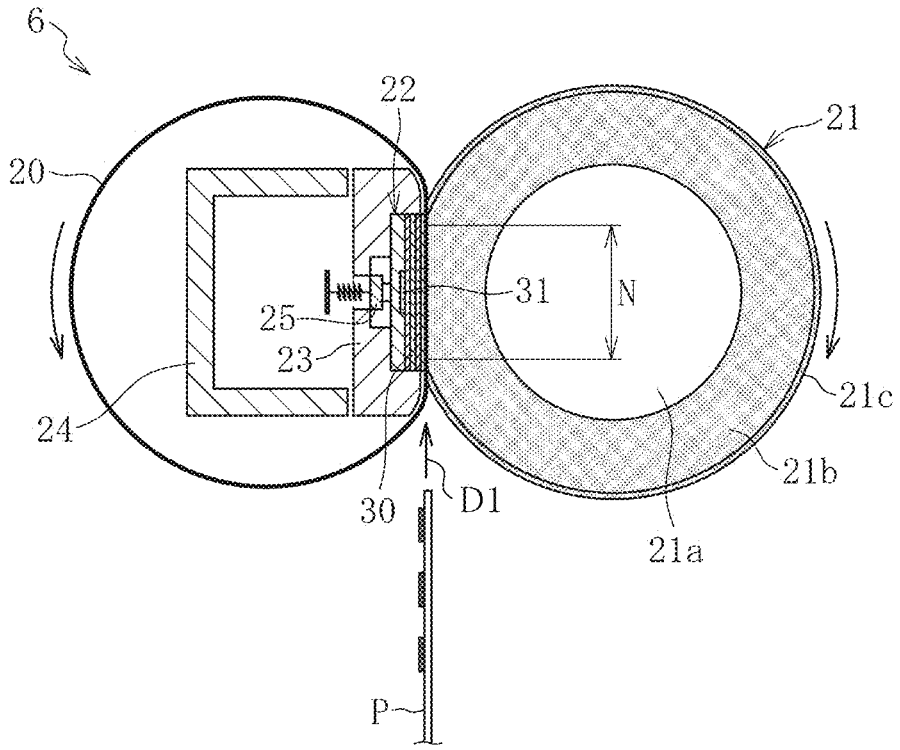
FIG. 2 is a side cross-sectional view of a fixing device incorporated in the image forming apparatus depicted in FIG. 1.

As illustrated in FIG. 2, the fixing device 6 according to this embodiment includes the fixing belt 20, the pressure roller 21, a heater 22, a heater holder 23, a stay 24, and a thermistor 25. The fixing belt 20 is an endless belt. The pressure roller 21 serves as a pressure rotator or a pressure member that contacts an outer circumferential surface of the fixing belt 20 to form a nip, that is, a fixing nip N, between the fixing belt 20 and the pressure roller 21. The heater 22 serves as a heater or a heating member that heats the fixing belt 20. The heater holder 23 serves as a holder that holds or supports the heater 22. The stay 24 contacts a rear face of the heater holder 23, thus serving as a contact member that contacts and supports the heater holder 23. The thermistor 25 serves as a temperature detector that detects the temperature of the fixing belt 20.

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member biases the pressure roller 21 toward the fixing belt 20, pressing the pressure roller 21 against the heater 22 via the fixing belt 20. Thus, the fixing nip N is formed between the fixing belt 20 and the pressure roller 21. A driver drives and rotates the pressure roller 21. As the pressure roller 21 rotates in a rotation direction indicated with an arrow in FIG. 2, the fixing belt 20 is driven and rotated by the pressure roller 21.

A detailed description is now given of a construction of the heater 22.

The heater 22 is a laminated heater that is elongated in a longitudinal direction thereof throughout an entire length of the fixing belt 20 in a width direction, that is, an axial direction, of the fixing belt 20. The width direction of the fixing belt 20 is perpendicular to a plane of paper in FIG. 2 and parallel to the longitudinal direction of the heater 22 and a longitudinal direction of the heater holder 23. The heater 22 includes a base 30 that is platy, resistive heat generators 31 serving as heat generators that are disposed on the base 30, and an insulating layer that coats the resistive heat generators 31. The insulating layer of the heater 22 contacts the inner circumferential surface of the fixing belt 20. Heat generated by the resistive heat generators 31 is conducted to the fixing belt 20 through the insulating layer.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side plates of the fixing device 6, respectively. Since the stay 24 supports the heater holder 23 and the heater 22 supported by the heater holder 23, in a state in which the pressure roller 21 is pressed against the fixing belt 20, the heater 22 receives pressure from the pressure roller 21 precisely to form the fixing nip N stably.

Since the heater holder 23 is subject to high temperatures by heat from the heater 22, the heater holder 23 is preferably made of a heat resistant material. For example, if the heater holder 23 is made of heat resistant resin having a decreased thermal conductivity, such as liquid crystal polymer (LCP), the heater holder 23 suppresses conduction of heat thereto from the heater 22, facilitating heating of the fixing belt 20.

In the fixing device 6 according to this embodiment, when printing starts, the driver drives and rotates the pressure roller 21 and the fixing belt 20 starts rotation in accordance with rotation of the pressure roller 21. Additionally, as power is supplied to the resistive heat generators 31 of the heater 22, the heater 22 heats the fixing belt 20. In a state in which the temperature of the fixing belt 20 reaches a predetermined target temperature (e.g., a fixing temperature), as a sheet P bearing an unfixed toner image is conveyed in a sheet conveyance direction D1 through the fixing nip N formed between the fixing belt 20 and the pressure roller 21, the fixing belt 20 and the pressure roller 21 fix the unfixed toner image on the sheet P under heat and pressure.

Figure 3A:
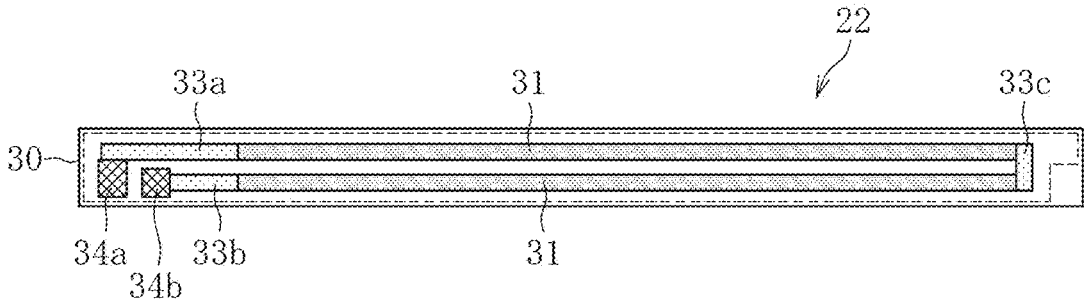
FIG. 3A is a front view of a heater incorporated in the fixing device depicted in FIG. 2.
Figure 3B:
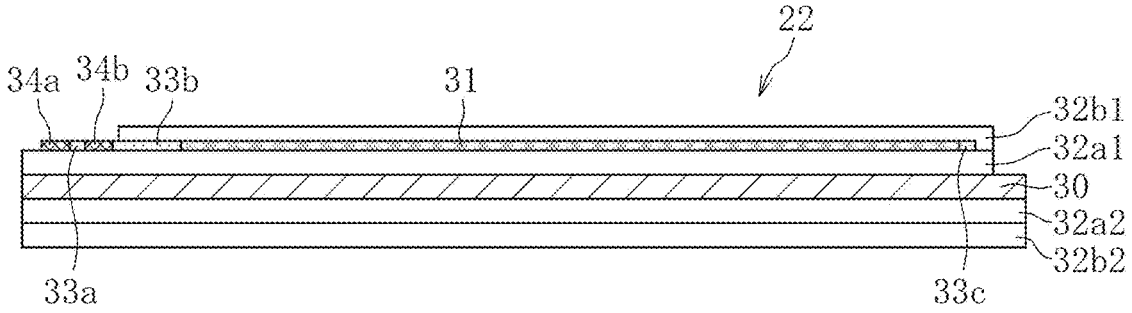
FIG. 3B is a side cross-sectional view of the heater depicted in FIG. 3A.

Referring to FIGS. 3A and 3B, a description is provided of the construction of the heater 22 in more detail.

As illustrated in FIG. 3A, a surface of the base 30, that is, an elongate plate, mounts the resistive heat generators 31, feeders 33*a*, 33*b*, and 33*c*, electrodes 34*a* and 34*b*, and the like. The resistive heat generators 31 are arranged in two lines and extended in the longitudinal direction of the heater 22. The insulating layer or the like covers and insulates surfaces of the base 30, the resistive heat generators 31, the feeders 33*a*, 33*b*, and 33*c*, and the electrodes 34*a* and 34*b*, respectively.

The base 30 is preferably made of ceramic (e.g., alumina and aluminum nitride), glass, mica, or heat resistant resin (e.g., PI) which has an increased heat resistance and an increased insulation. For example, as a conductive material, a material having an increased thermal conductivity, such as aluminum, copper, silver, graphite, and graphene, is preferably used. The material having the increased thermal conductivity evens the temperature of an entirety of the heater 22 by thermal conduction, improving quality of a toner image fixed on a sheet P.

The resistive heat generators 31 and the feeders 33*a*, 33*b*, and 33*c* are produced as below. Silver (Ag), palladium (Pd), platinum (Pt), ruthenium oxide ($RuO_2$), and the like are mixed into paste made of a conductive material. The paste coats the base 30 by screen printing or the like. Thereafter, the base 30 is subject to firing.

The resistive heat generators 31 are connected to the electrodes 34*a* and 34*b* through the feeders 33*a* and 33*b*, respectively, at one lateral end of each of the resistive heat generators 31 in a longitudinal direction thereof. The resistive heat generators 31 are connected to each other through the feeder 33*c* extending in a short direction of the heater 22 at another lateral end of each of the resistive heat generators 31 in the longitudinal direction thereof.

As illustrated in FIG. 3B, the heater 22 is constructed of a plurality of layers that includes insulating glass layers 32*a*1 and 32*a*2 and insulating protective layers 32*b*1 and 32*b*2. The insulating glass layer 32*a*1 is an upper layer disposed on the base 30. The insulating glass layer 32*a*2 is a lower layer disposed on the base 30. The insulating protective layer 32*b*1 is an upper layer disposed on the insulating glass layer 32*a*1. The insulating protective layer 32*b*2 is a lower layer disposed on the insulating glass layer 32*a*2. The resistive heat generators 31, the feeders 33*a*, 33*b*, and 33*c*, and the electrodes 34*a* and 34*b* are disposed on the base 30 via the insulating glass layer 32*a*1. The insulating protective layer 32*b*1 covers the surfaces of the resistive heat generators 31, the feeders 33*a*, 33*b*, and 33*c*, and the electrodes 34*a* and 34*b*, respectively.

The insulating protective layers 32*b*1 and 32*b*2 are preferably made of ceramic (e.g., alumina and aluminum nitride), glass, mica, or heat resistant resin (e.g., polyimide), which improves heat resistance and insulation of the insulating protective layers 32*b*1 and 32*b*2.

Figure 4:
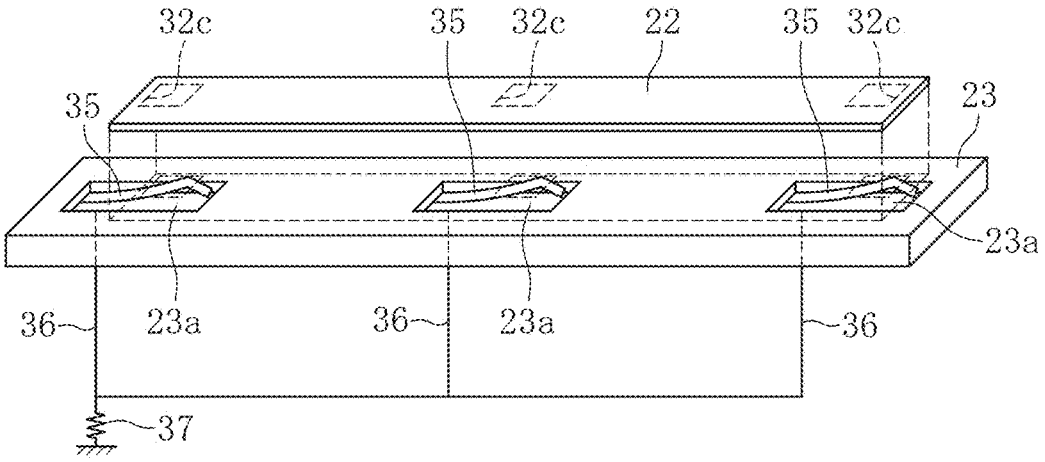
FIG. 4 is a perspective view of the heater and a heater holder incorporated in the fixing device depicted in FIG. 2, illustrating attachment of the heater to the heater holder.

Referring to FIG. 4, a description is provided of a configuration for grounding the base 30.

As illustrated in FIG. 4, elongate holes 23*a* are disposed on a center and both lateral ends of the heater holder 23 in the longitudinal direction thereof, respectively. Each of the elongate holes 23*a* is rectangular and has an opening that faces the heater 22. A flat spring 35 is disposed inside each of the elongate holes 23*a*. Each of the flat springs 35 is grounded through a wire 36 and a resistance 37.

A plurality of slots 32*c* penetrates through the insulating glass layer 32*a*1 and the insulating protective layer 32*b*1 of the heater 22 depicted in FIG. 3B. The slot 32*c* is disposed opposite a tip portion of the flat spring 35 depicted in FIG. 4. Accordingly, as the heater 22 is attached to the heater holder 23 at a position illustrated in a dotted line, a bent portion of the flat spring 35 comes into contact with a back face of the base 30 through the slot 32*c*.

A biasing force generated by the flat spring 35 brings the flat spring 35 into contact with the base 30 stably, attaching the base 30 to the heater holder 23 stably. Alternatively, instead of the flat spring 35, a harness may be coupled to the base 30 to ground the base 30 directly. Yet alternatively, the base 30 may be grounded through the stay 24.

Figure 5:
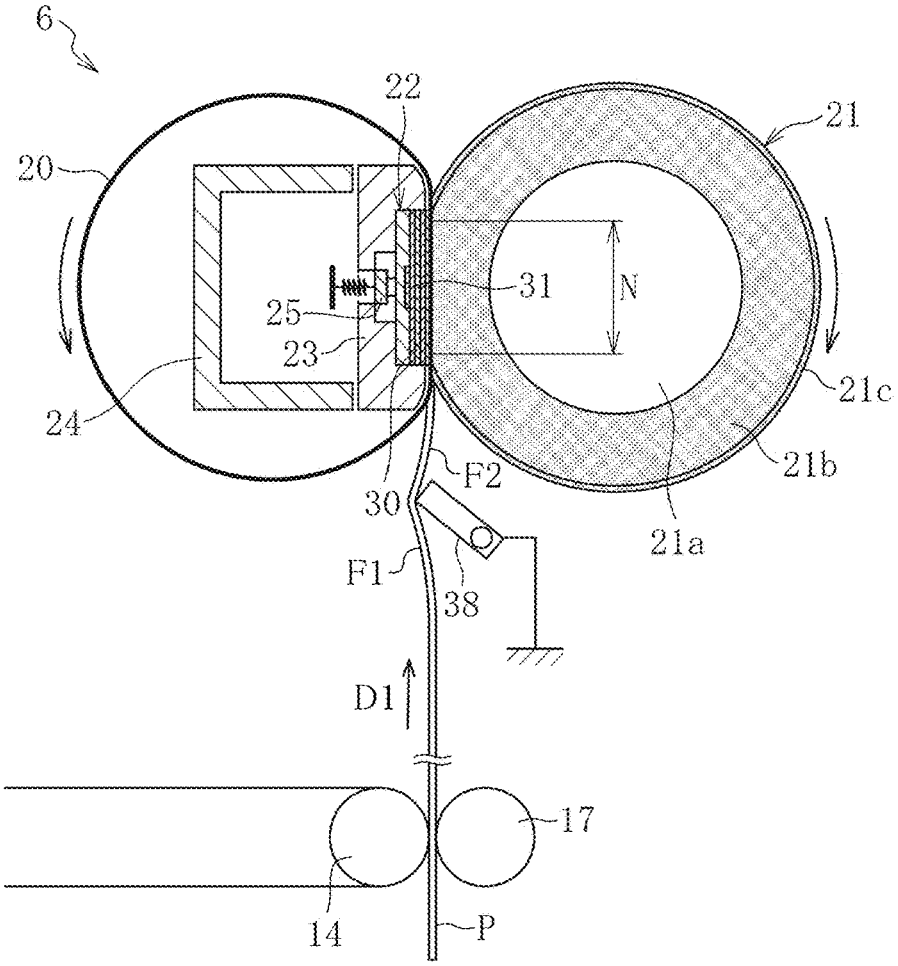
FIG. 5 is a side cross-sectional view of the fixing device depicted in FIG. 2, that incorporates a feeler according to a first embodiment of the present disclosure.
Figure 6:
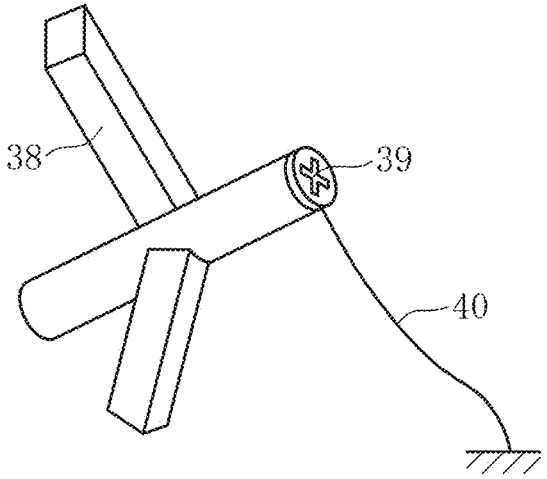
FIG. 6 is a perspective view of the feeler depicted in FIG. 5.
Figure 7:
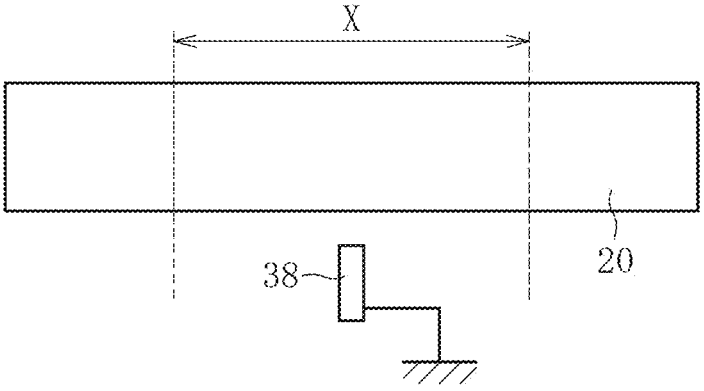
FIG. 7 is a diagram illustrating a positional relation between the feeler and a fixing belt incorporated in the fixing device depicted in FIG. 5 in a width direction of a sheet conveyed over the fixing belt.

Referring to FIGS. 5 to 7, a description is provided of a configuration of a feeler 38 disposed upstream from the fixing nip N in the sheet conveyance direction D1.

As illustrated in FIG. 5, the feeler 38 serving as a conductor is disposed upstream from the fixing nip N in the sheet conveyance direction D1 and is disposed opposite the pressure roller 21.

The feeler 38 is made of a conductive material. Alternatively, the feeler 38 may be made of an insulating material and have a surface performed with a conductive treatment. Yet alternatively, the feeler 38 may be adhered with a conductive seal or the like.

The feeler 38 has a sheet detecting function that determines whether or not a sheet P contacts the surface of the feeler 38. For example, the feeler 38 determines contact of the sheet P by checking the electric current that passes through the feeler 38 or by checking movement of the feeler 38.

The feeler 38 contacts a back face F2 of the sheet P conveyed from the secondary transfer nip to the fixing device 6. The back face F2 of the sheet P is opposite a fixing face F1 bearing a toner image to be fixed on the sheet P.

As illustrated in FIG. 6, a screw 39 serving as a fastener fastens a harness 40 to one end of the feeler 38. The harness 40 is coupled to a frame of the fixing device 6 and grounded through a body of the image forming apparatus 1.

As illustrated in FIG. 7, the feeler 38 is disposed within a conveyance span X in a width direction of the sheet P, that is, the axial direction of the fixing belt 20, where a minimum sheet P having a minimum width of a plurality of widths of sheets P is conveyed through the fixing device 6. Accordingly, the feeler 38 contacts the sheets P of various sizes, that are conveyed through the fixing device 6. For example, the feeler 38 is disposed opposite substantially a center of the fixing belt 20 in the axial direction thereof.

A description is provided of a configuration of a comparative fixing device.

In order to prevent an alternating current from flowing to a transfer nip, the comparative fixing device includes a guide that guides a recording medium to a fixing nip. The guide is disposed upstream from the fixing nip in a recording medium conveyance direction. The guide includes a conductor that is grounded. Accordingly, when the alternating current applied to a heater flows toward the recording medium, the alternating current moves to the guide. Thus, the alternating current does not flow to the transfer nip.

However, the recording medium may not contact the guide depending on a posture of the recording medium when the recording medium is conveyed to the comparative fixing device. Hence, with the construction of the comparative fixing device, when the recording medium does not contact the guide, the alternating current may flow to the transfer nip, causing uneven density of the toner image.

Figure 8B:
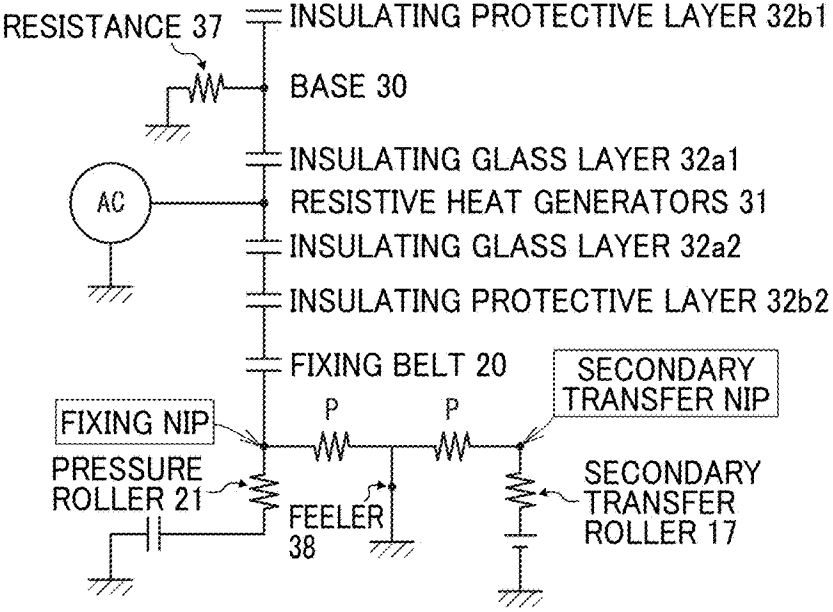
FIG. 8B is a diagram of an equivalent circuit of the fixing device that incorporates the feeler depicted in FIG. 5.
Figure 8A:
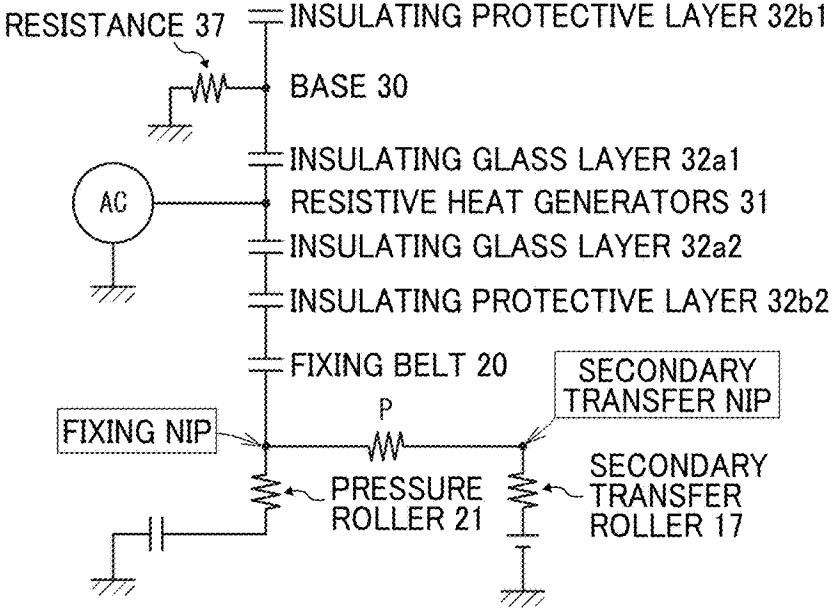
FIG. 8A is a diagram of an equivalent circuit of a fixing device that does not incorporate the feeler depicted in FIG. 5.

Referring to FIGS. 8A and 8B, a description is provided of a grounding configuration for grounding a periphery of the fixing device 6.

FIG. 8A is a diagram illustrating a configuration of a fixing device that does not incorporate the feeler 38 unlike the fixing device 6 according to this embodiment. FIG. 8B is a diagram illustrating a configuration of the fixing device 6 according to this embodiment. FIGS. 8A and 8B illustrate a state in which a sheet P is sandwiched at the secondary transfer nip and the fixing nip N.

As illustrated in FIG. 8A, the insulating glass layer 32*a*2 and the insulating protective layer 32*b*2 insulate the fixing belt 20 from the base 30. Hence, in the fixing device without the feeler 38, even if the base 30 is grounded, an electric charge of the fixing belt 20 is not cancelled. Accordingly, when an alternating current is applied to the resistive heat generators 31, the alternating current is applied to the secondary transfer nip through the fixing belt 20 and the sheet P, causing uneven density (e.g., image unevenness) or the like of a toner image formed on the sheet P.

Conversely, in the fixing device 6 according to this embodiment depicted in FIG. 8B, as the feeler 38 that is grounded contacts the sheet P, the feeler 38 attracts the alternating current flown to the sheet P through the fixing belt 20, preventing the alternating current from flowing to the secondary transfer nip. Accordingly, the fixing device 6 prevents uneven density of the toner image formed on the sheet P, that may be caused by the alternating current flowing to the secondary transfer nip.

Figure 9:
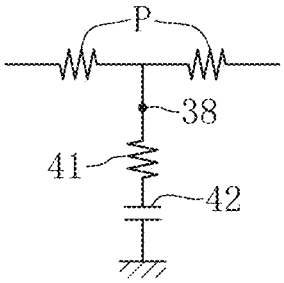
FIG. 9 is a diagram of the feeler depicted in FIG. 5, that is grounded through a resistance and a capacitor.

As illustrated in FIG. 9, a resistance 41 and a capacitor 42 (e.g., a capacitance element) are interposed between the feeler 38 and the frame of the fixing device 6. The resistance 41 suppresses flowing of the alternating current from the secondary transfer nip to the feeler 38 through the sheet P, preventing shortage of the alternating current at the secondary transfer nip and resultant faulty formation of the toner image on the sheet P. The capacitor 42 attenuates an alternating voltage, suppressing a banding image due to fuser alternating current (AC) interference with a transfer voltage.

The feeler 38 has the sheet detecting function that determines whether or not the feeler 38 contacts the sheet P. Accordingly, the fixing device 6 attains the above-described grounding configuration stably, preventing uneven density of the toner image formed on the sheet P, that may be caused by the alternating current flowing to the secondary transfer nip, precisely.

Additionally, the feeler 38 is also used as a residual sheet detecting sensor that detects the sheet P remained at the fixing nip N or the like, decreasing the number of parts of the fixing device 6.

A description is provided of a method for bringing the sheet P into contact with the feeler 38 with the sheet detecting function of the feeler 38 when the sheet P does not contact the feeler 38.

According to this embodiment, while printing is performed, if the feeler 38 does not detect contact with the sheet P, a conveyance speed at which the sheet P is conveyed through the secondary transfer nip or the fixing nip N, that is, a rotation speed of the driving roller 14 or the pressure roller 21, is changed, thus bringing the sheet P into contact with the feeler 38.

Figure 10A:
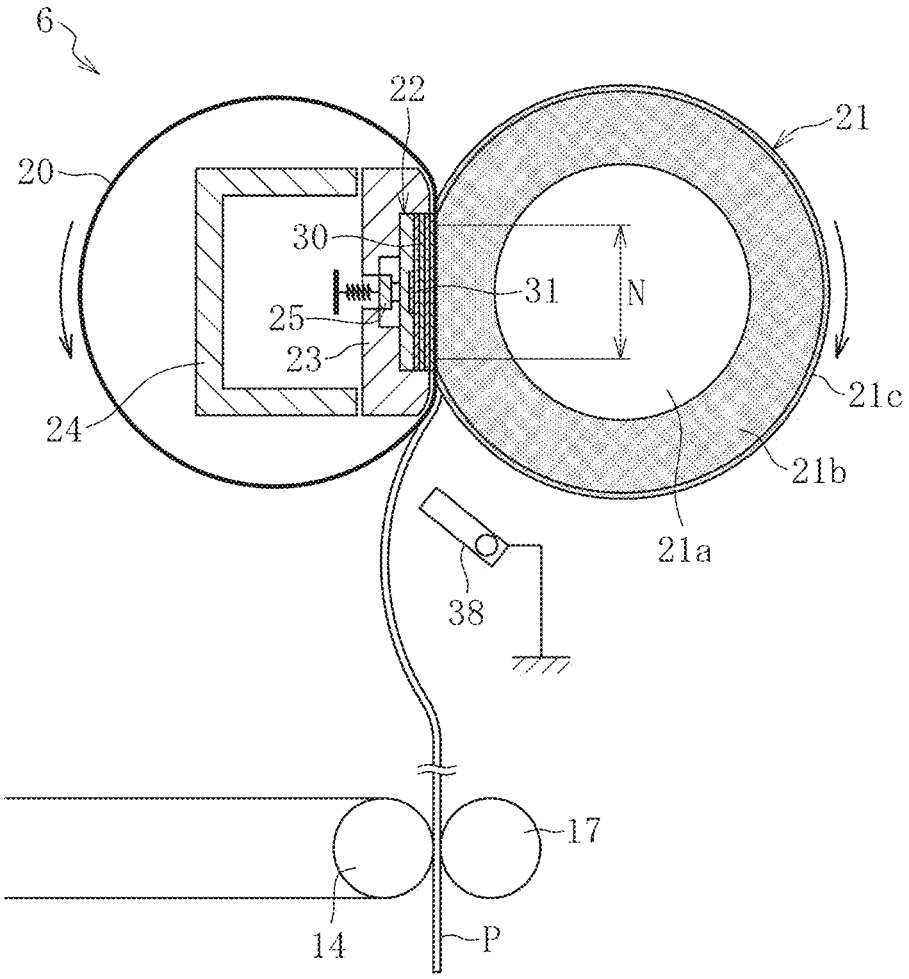
FIG. 10A is a side cross-sectional view of the fixing device depicted in FIG. 5, illustrating the feeler and a bent sheet that is separated from the feeler.
Figure 10B:
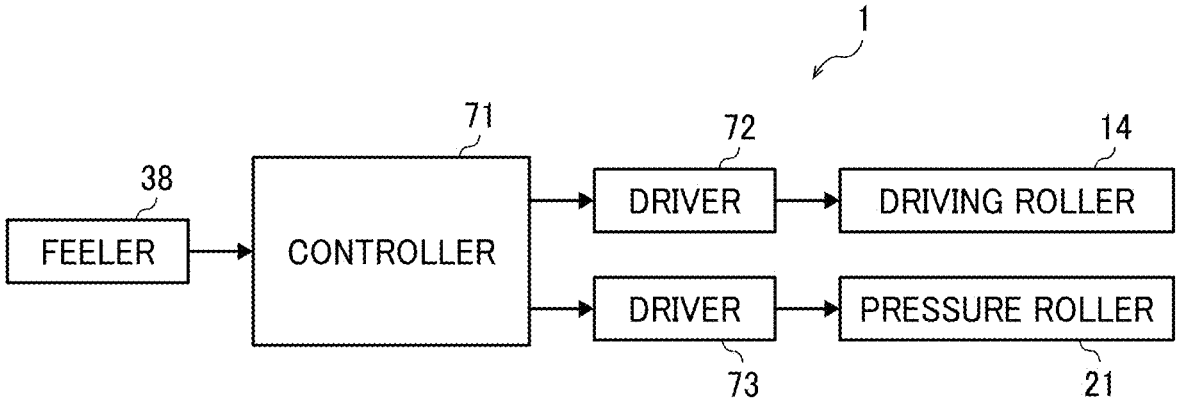
FIG. 10B is a block diagram of an image forming apparatus depicted in FIG. 1.

FIG. 10A is a schematic cross-sectional view of the fixing device 6, the driving roller 14, and the secondary transfer roller 17. FIG. 10B is a block diagram of the image forming apparatus 1. As illustrated in FIG. 10B, the image forming apparatus 1 includes a controller 71 and drivers 72 and 73. The controller 71 may be situated in the fixing device 6 or the image forming apparatus 1. The controller 71 is operatively connected to the feeler 38 and the drivers 72 and 73.

For example, as illustrated in FIG. 10A, if the sheet P is bent and separated from the feeler 38, the controller 71 depicted in FIG. 10B controls the driver 72 to drive and rotate the driving roller 14 at a decreased rotation speed. Alternatively, the controller 71 controls the driver 73 to drive and rotate the pressure roller 21 at an increased rotation speed. Accordingly, the driving roller 14 or the pressure roller 21 stretches the sheet P as illustrated in FIG. 5, bringing the sheet P into contact with the feeler 38.

Figure 11B:
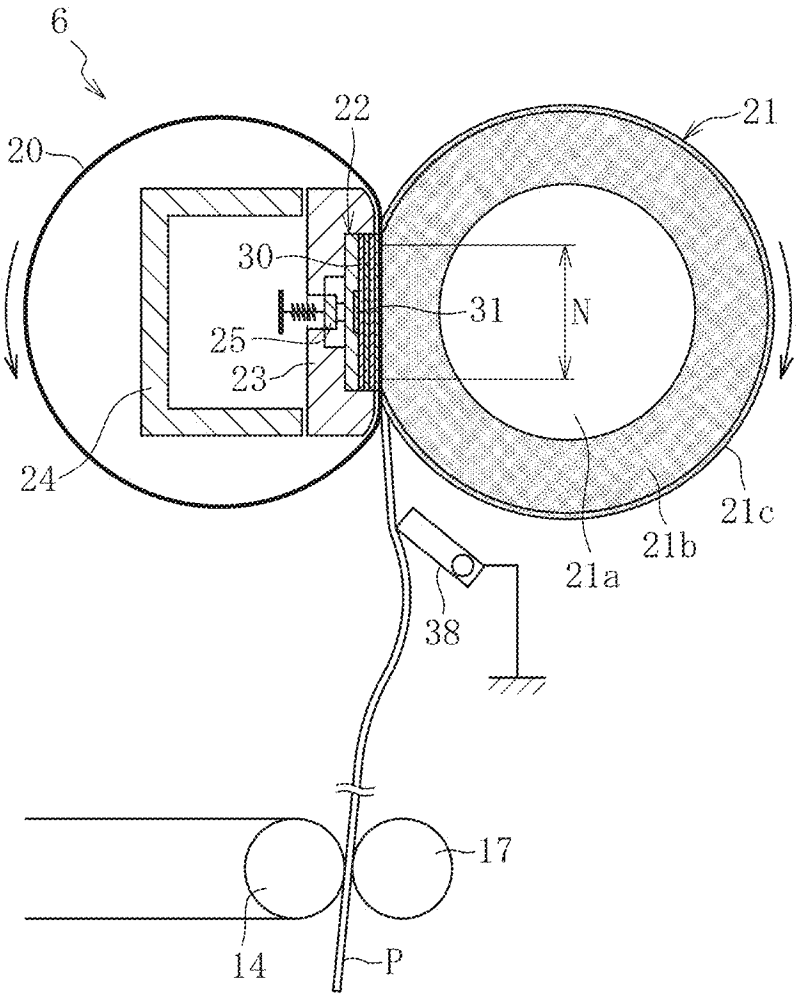
FIG. 11B is a side cross-sectional view of the fixing device depicted in FIG. 5, illustrating the feeler and a bent sheet that contacts the feeler.
Figure 11A:
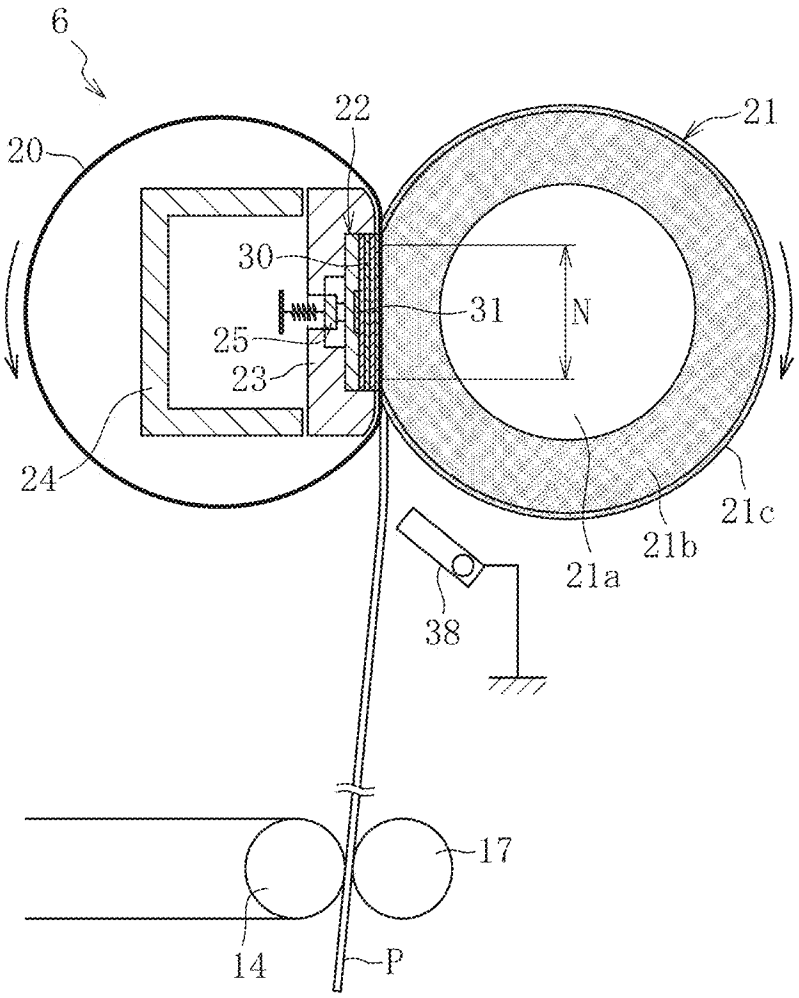
FIG. 11A is a side cross-sectional view of the fixing device depicted in FIG. 5, illustrating the feeler and a stretched sheet that is separated from the feeler.

Conversely, as illustrated in FIG. 11A, if the sheet P is stretched and separated from the feeler 38, the controller 71 controls the driver 72 to drive and rotate the driving roller 14 at an increased rotation speed. Alternatively, the controller 71 controls the driver 73 to drive and rotate the pressure roller 21 at a decreased rotation speed. Accordingly, the driving roller 14 or the pressure roller 21 bends the sheet P as illustrated in FIG. 11B, bringing the sheet P into contact with the feeler 38. Thus, if the sheet P does not contact the feeler 38, the controller 71 increases or decreases the rotation speed of the driving roller 14 or the pressure roller 21, bringing the sheet P into contact with the feeler 38.

Figure 12:
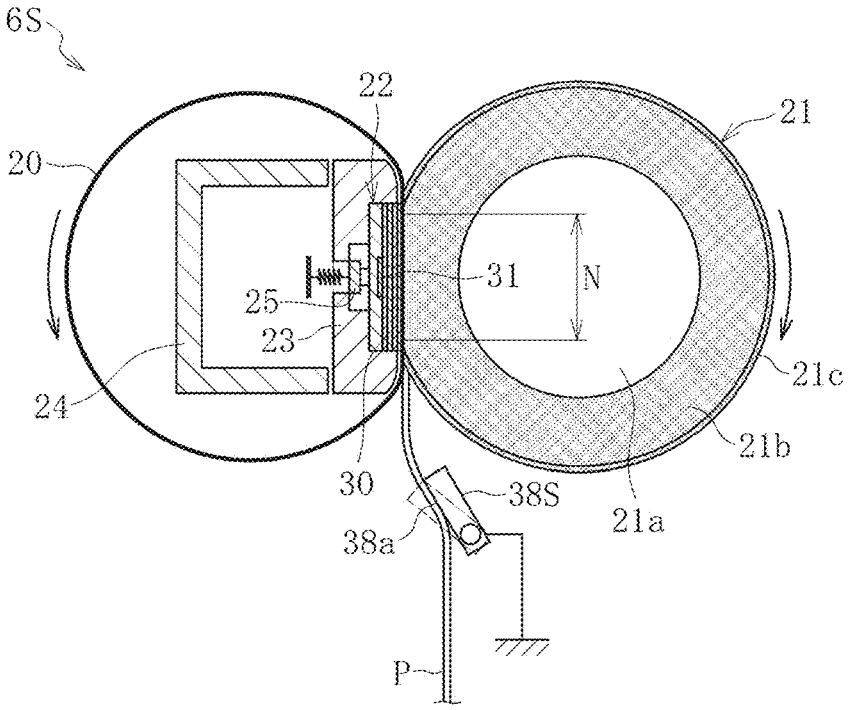
FIG. 12 is a side cross-sectional view of a fixing device incorporating a feeler according to a second embodiment of the present disclosure, that is installable in the image forming apparatus depicted in FIG. 1.

FIG. 12 is a side cross-sectional view of a fixing device 6S incorporating a feeler 38S. As illustrated in FIG. 12, the feeler 38S serving as a conductor also serves as a guide that guides the sheet P to the fixing nip N. For example, as illustrated in FIG. 12, the feeler 38S includes a guide face 38*a* that contacts and guides the sheet P to the fixing nip N. Like the embodiments described above, the feeler 38S has the sheet detecting function that determines whether or not the sheet P contacts the feeler 38S.

The feeler 38S is movable. As the sheet P contacts and strikes the feeler 38S, the feeler 38S pivots rightward in FIG. 12 such that the feeler 38S moves from a position indicated with a dotted line to a position indicated with a solid line. Accordingly, as the sheet P contacts the guide face 38*a* of the feeler 38S, the feeler 38S decreases a striking force with which the sheet P contacts and strikes the guide face 38*a* of the feeler 38S, preventing a leading end of the sheet P from being folded or damaged, for example.

The above describes the embodiments of the present disclosure. However, the technology of the present disclosure is not limited to the embodiments described above and is modified within the scope of the present disclosure.

For example, the image forming apparatus 1 according to the embodiments of the present disclosure depicted in FIG. 1 is not limited to a color image forming apparatus that forms a color toner image. Alternatively, the image forming apparatus 1 may be a monochrome image forming apparatus that forms a monochrome toner image, a copier, a printer, a facsimile machine, a multifunction peripheral (MFP) having at least two of printing, copying, facsimile, scanning, and plotter functions, or the like.

The recording media include, in addition to plain paper as a sheet P, thick paper, a postcard, an envelope, thin paper, coated paper, art paper, tracing paper, an overhead projector (OHP) transparency, plastic film, prepreg, and copper foil.

Figure 13:
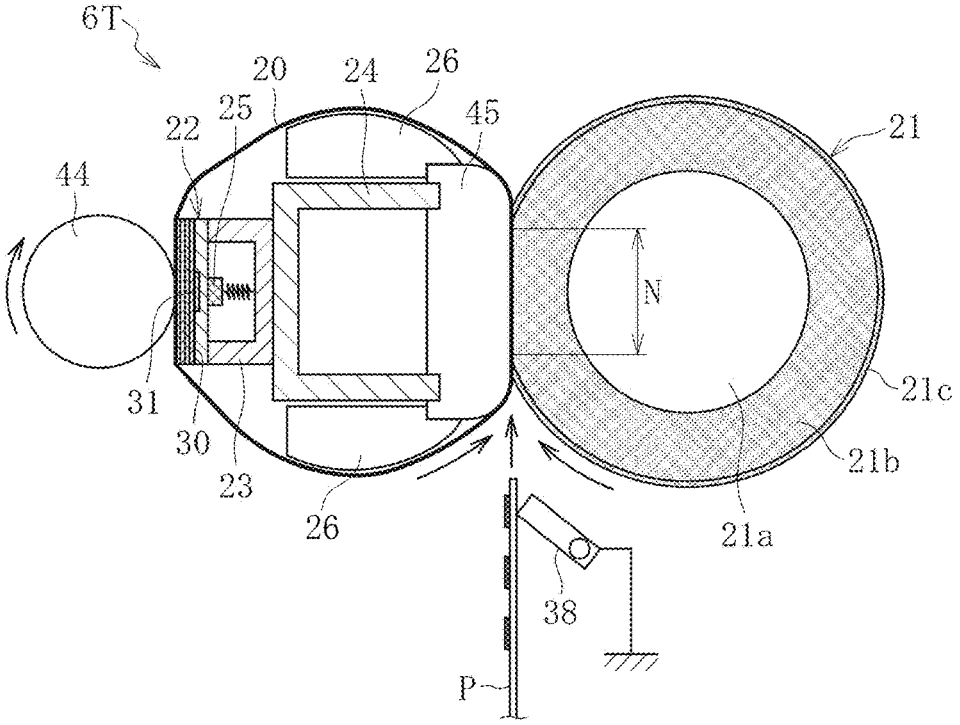
FIG. 13 is a schematic cross-sectional view of a fixing device as a first variation of the fixing device depicted in FIG. 2.
Figure 14:
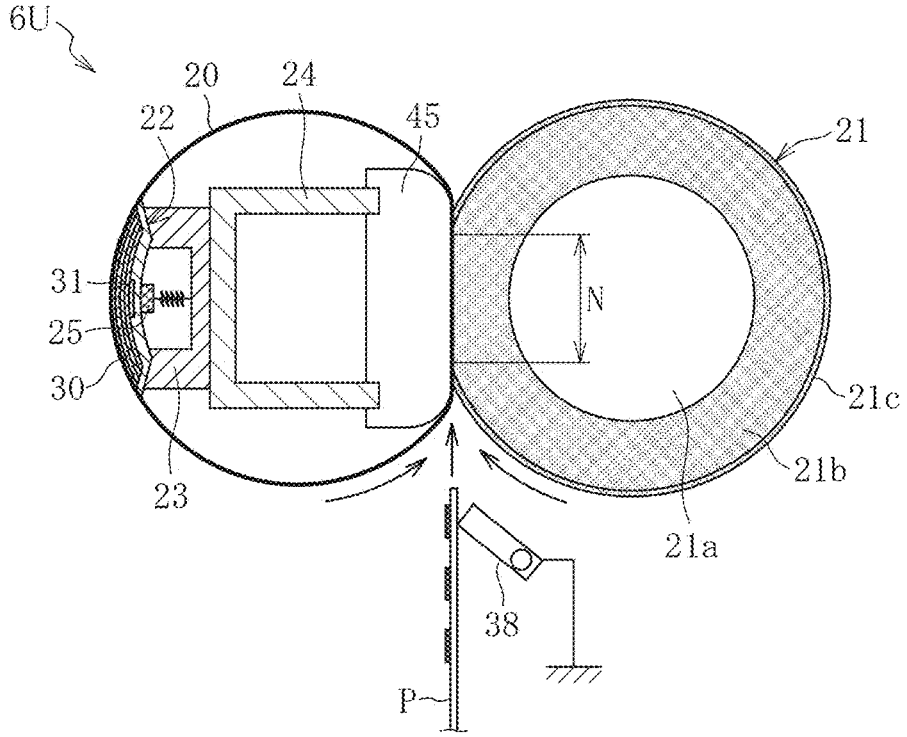
FIG. 14 is a schematic cross-sectional view of a fixing device as a second variation of the fixing device depicted in FIG. 2.
Figure 15:
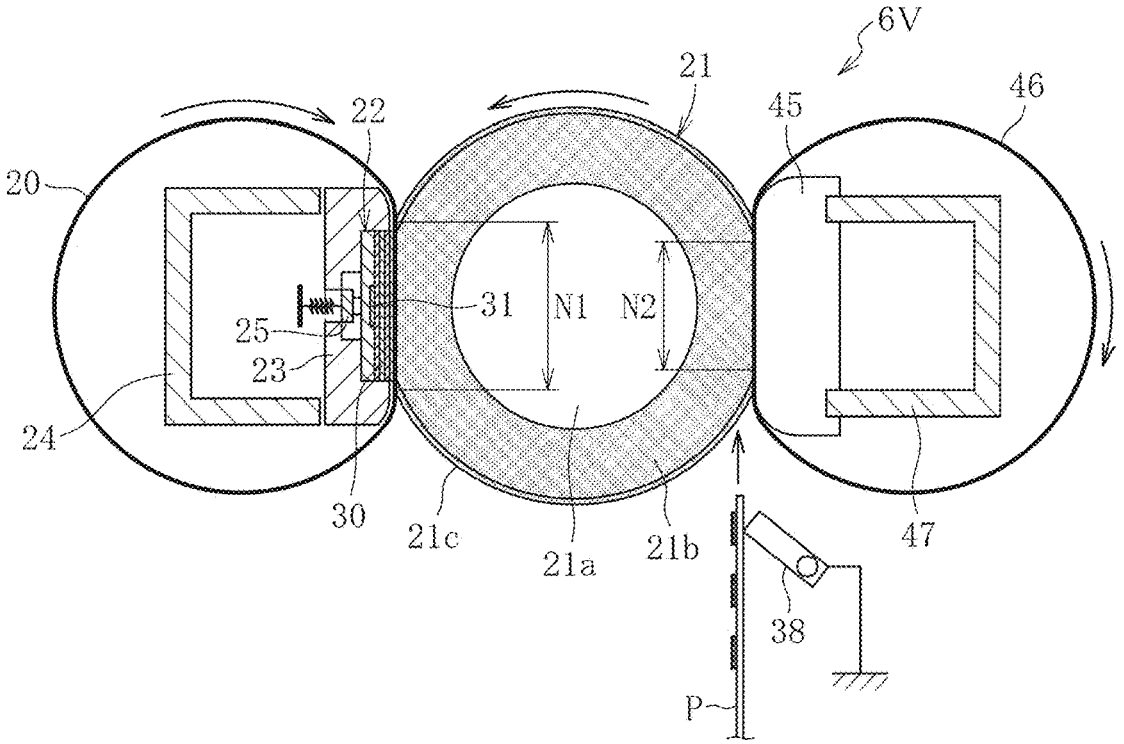
FIG. 15 is a schematic cross-sectional view of a fixing device as a third variation of the fixing device depicted in FIG. 2.

The embodiments of the present disclosure are also applicable to fixing devices 6T, 6U, and 6V illustrated in FIGS. 13 to 15, respectively, other than the fixing device 6 illustrated in FIG. 2, for example. The following briefly describes a construction of each of the fixing devices 6T, 6U, and 6V depicted in FIGS. 13 to 15, respectively.

A description is provided of the construction of the fixing device 6T.

As illustrated in FIG. 13, the fixing device 6T includes a pressing roller 44 disposed opposite the pressure roller 21 via the fixing belt 20. The pressing roller 44 and the heater 22 sandwich the fixing belt 20 so that the heater 22 heats the fixing belt 20. On the other hand, a nip forming pad 45 is disposed inside the loop formed by the fixing belt 20 and disposed opposite the pressure roller 21. The stay 24 supports the nip forming pad 45. The nip forming pad 45 and the pressure roller 21 sandwich the fixing belt 20 and define the fixing nip N. The nip forming pad 45 mounts guides 26 that guide the fixing belt 20.

A description is provided of the construction of the fixing device 6U depicted in FIG. 14.

As illustrated in FIG. 14, the fixing device 6U does not include the pressing roller 44 described above with reference to FIG. 13. In order to attain a contact length for which the heater 22 contacts the fixing belt 20 in a circumferential direction thereof, the heater 22 is curved into an arc in cross section that corresponds to a curvature of the fixing belt 20. Other construction of the fixing device 6U is equivalent to that of the fixing device 6T depicted in FIG. 13.

A description is provided of the construction of the fixing device 6V depicted in FIG. 15.

As illustrated in FIG. 15, the fixing device 6V includes a pressure belt 46 in addition to the fixing belt 20. The pressure belt 46 and the pressure roller 21 form a fixing nip N2 serving as a secondary nip separately from a heating nip N1 serving as a primary nip formed between the fixing belt 20 and the pressure roller 21. For example, the nip forming pad 45 and a stay 47 are disposed opposite the fixing belt 20 via the pressure roller 21. The pressure belt 46 that is rotatable accommodates the nip forming pad 45 and the stay 47. As a sheet P bearing a toner image is conveyed through the fixing nip N2 formed between the pressure belt 46 and the pressure roller 21, the pressure belt 46 and the pressure roller 21 fix the toner image on the sheet P under heat and pressure. Other construction of the fixing device 6V is equivalent to that of the fixing device 6 depicted in FIG. 2. With the constructions of the fixing devices 6S, 6T, 6U, and 6V also, the alternating current applied to the resistive heat generators 31 may flow to the fixing belt 20 and the pressure roller 21 and to the secondary transfer nip through the sheet P.

To address this circumstance, each of the fixing devices 6S, 6T, 6U, and 6V also includes the feeler 38 or 38S. Accordingly, the feeler 38 or 38S prevents the alternating current applied to the resistive heat generators 31 from being applied to the fixing belt 20 and the pressure roller 21 and to the secondary transfer nip through the sheet P, thus preventing uneven density of the toner image formed on the sheet P.

A description is provided of advantages of a fixing device (e.g., the fixing devices 6, 6S, 6T, 6U, and 6V).

As illustrated in FIG. 5, the fixing device includes an endless belt (e.g., the fixing belt 20), a pressure rotator (e.g., the pressure roller 21), a heater (e.g., the heater 22), and a conductor (e.g., the feelers 38 and 38S). The endless belt is rotatable. The pressure rotator is rotatable and presses against the endless belt to form a fixing nip (e.g., the fixing nip N) between the endless belt and the pressure rotator. A recording medium bearing an image is conveyed through the fixing nip. The heater is disposed inside a loop formed by the endless belt and heats the endless belt. The conductor is disposed upstream from the pressure rotator in a recording medium conveyance direction (e.g., the sheet conveyance direction D1). The conductor contacts the recording medium. The conductor is grounded and detects the recording medium that contacts the conductor.

Accordingly, the conductor contacts the recording medium stably, thus grounding the recording medium through the conductor. Consequently, the conductor prevents an alternating current applied to the heater from flowing to an upstream position disposed upstream from the fixing device in the recording medium conveyance direction. For example, the conductor prevents the alternating current from flowing to a transfer nip (e.g., the secondary transfer nip) precisely.

According to the embodiments described above, the fixing belt 20 serves as an endless belt. Alternatively, a fixing film, a fixing sleeve, or the like may be used as an endless belt. Further, the pressure roller 21 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A fixing device comprising:

an endless belt configured to rotate;

a pressure rotator configured to rotate and press against the endless belt to form a fixing nip between the endless belt and the pressure rotator, the fixing nip through which a recording medium bearing an image is conveyed;

a heater disposed inside a loop formed by the endless belt, the heater configured to heat the endless belt; and a conductor disposed upstream from the pressure rotator in a recording medium conveyance direction and grounded, the conductor configured to contact the recording medium, ground the recording medium, and detect contact with the recording medium.

2. The fixing device according to claim 1, further comprising a resistance through which the conductor is grounded.

3. The fixing device according to claim 1, further comprising a capacitance element through which the conductor is grounded.

4. The fixing device according to claim 3,
wherein the capacitance element includes a capacitor.

5. The fixing device according to claim 1,
wherein the conductor is disposed within a conveyance span in an axial direction of the endless belt, the conveyance span where the recording medium having a minimum width of a plurality of widths of recording media is conveyed through the fixing device.

6. The fixing device according to claim 1, further comprising:
a harness; and
a fastener configured to fasten the harness to the conductor,
wherein the conductor is grounded through the harness.

7. The fixing device according to claim 6,
wherein the fastener includes a screw.

8. The fixing device according to claim 1,
wherein the conductor contacts a back face of the recording medium, the back face being opposite a fixing face of the recording medium, the fixing face that bears the image to be fixed.

9. The fixing device according to claim 1,
wherein the conductor includes a guide face configured to guide the recording medium to the fixing nip.

10. The fixing device according to claim 1,
wherein the conductor includes a feeler.

11. The fixing device according to claim 1,
wherein the conductor is disposed opposite substantially a center of the endless belt in an axial direction of the endless belt.

12. An image forming apparatus comprising:
an endless belt configured to rotate;
a pressure rotator configured to rotate and press against the endless belt to form a fixing nip between the endless belt and the pressure rotator, the fixing nip through which a recording medium bearing an image is conveyed;
a heater disposed inside a loop formed by the endless belt, the heater configured to heat the endless belt;
a conductor disposed upstream from the pressure rotator in a recording medium conveyance direction and grounded, the conductor configured to contact and detect the recording medium; and
a controller operatively connected to the conductor, the controller configured to change a rotation speed at which the pressure rotator rotates to convey the recording medium if the conductor does not detect that the recording medium contacts the conductor.

13. The image forming apparatus according to claim 12,
wherein the controller controls the pressure rotator to rotate at an increased rotation speed when the recording medium is separated from the conductor.

14. An image forming apparatus comprising:
an image bearer configured to bear an image; and
a fixing device configured to fix the image on a recording medium, the fixing device including:
an endless belt configured to rotate;
a pressure rotator configured to rotate and press against the endless belt to form a fixing nip between the endless belt and the pressure rotator, the fixing nip through which the recording medium bearing the image is conveyed;
a heater disposed inside a loop formed by the endless belt, the heater configured to heat the endless belt; and
a conductor disposed upstream from the pressure rotator in a recording medium conveyance direction and grounded, the conductor configured to contact the recording medium, ground the recording medium, and detect contact with the recording medium.

15. The image forming apparatus according to claim 14, further comprising an image transferor configured to transfer the image onto the recording medium and convey the recording medium downstream in the recording medium conveyance direction.

16. The image forming apparatus according to claim 15, further comprising a controller operatively connected to the conductor, the controller configured to change a conveyance speed at which the image transferor conveys the recording medium if the conductor does not detect that the recording medium contacts the conductor.

17. The image forming apparatus according to claim 16,
wherein the image transferor includes a driving roller configured to rotate.

18. The image forming apparatus according to claim 17,
wherein the controller controls the driving roller to rotate at an increased rotation speed when the recording medium is separated from the conductor.

19. The fixing device according to claim 14,
wherein the conductor comprises a flat spring grounded through a wire.

20. The image forming apparatus according to claim 14,
further comprising a controller operatively connected to the conductor, the controller configured to change a rotation speed at which the pressure rotator rotates to convey the recording medium if the conductor does not detect that the recording medium contacts the conductor.

* * * * *